US007950966B1

(12) United States Patent
Chen et al.

(10) Patent No.: US 7,950,966 B1
(45) Date of Patent: May 31, 2011

(54) AUDIO JACK CONNECTOR

(75) Inventors: Chung-Yu Chen, Tu-Cheng (TW); Chung-Hsin Huang, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/640,406

(22) Filed: Dec. 17, 2009

(51) Int. Cl.
*H01R 13/00* (2006.01)

(52) U.S. Cl. ..... 439/668; 439/857

(58) Field of Classification Search ..... 439/668, 439/857, 669, 856
See application file for complete search history.

(56) References Cited

U.S. PATENT DOCUMENTS 5,022,872 A * 6/1991 Shichida ..... 439/668
5,462,459 A * 10/1995 Childs ..... 439/843
5,634,830 A * 6/1997 Weingartner ..... 439/857
6,171,126 B1 * 1/2001 Wu et al. ..... 439/224
6,186,833 B1 * 2/2001 Wu ..... 439/668
6,273,760 B1 * 8/2001 Wu ..... 439/668
6,709,301 B2 * 3/2004 Lee ..... 439/857
2002/0065006 A1 * 5/2002 Heimueller ..... 439/856
2003/0199210 A1 * 10/2003 Chang ..... 439/857
* cited by examiner

*Primary Examiner* — Gary F. Paumen
(74) *Attorney, Agent, or Firm* — Cheng-Ju Chiang

(57) ABSTRACT

An audio jack connector for mating with an audio plug connector has an insulating housing. The insulating housing defines an inserting hole extended from the front to the rear for receiving the audio plug connector and a recess communicating with the inserting hole at a rear end thereof. A terminal received in the recess has a base plate. Two opposite sides of the base plate extend downwards to form two fixing wings. Two facing contacting arms extend frontward from two front edges of the two fixing wings. Free ends of the contacting arms arch towards each other to form two smooth V-shaped contacting portions protruded into the inserting hole. Each of the contacting portions has two spaced smooth ribs protruded from an inner surface thereof and spreading towards two ends of the contacting portion from a peak of the contacting portion to form a smooth V-shape.

5 Claims, 5 Drawing Sheets

AUDIO JACK CONNECTOR

BACKGROUND OF THE INVENTION

1. Field of the Invention

The present invention relates to an audio jack connector, and more particularly to an audio jack connector having a terminal capable of improving signal transmission quality.

2. The Related Art

Audio jack connectors are widely used in kinds of electronic equipments, such as MP3/MP4, mobile phones, computers and other equipments for transmitting sound signals. A conventional audio jack connector includes an insulating housing and a terminal received in a rear of the insulating housing. The insulating housing defines an insertion hole for an audio plug inserted thereinto. The terminal has a base portion fixed in the insulating housing, and a single cantilever contact portion extended from the base portion and projected into the insertion hole. When the audio plug is inserted into the insulating housing, the cantilever contact portion abuts against a portion of one side of a tip end of the audio plug, in other words, the cantilever contact portion may push the audio plug aside. This will cause the audio plug contacted with other terminals of the audio jack connector insufficiently, and as a result, signal transmission between the audio jack connector and the audio plug will be influenced.

SUMMARY OF THE INVENTION

Accordingly, an object of the present invention is to provide an audio jack connector for mating with an audio plug connector. The audio jack connector has an insulating housing. The insulating housing defines an inserting hole extended from the front to the rear for receiving the audio plug connector and a recess communicating with the inserting hole at a rear end thereof. A terminal received in the recess has a base plate. Two opposite sides of the base plate extend downwards to form two fixing wings. Two facing contacting arms are extended frontward from two front edges of the two fixing wings. Free ends of the contacting arms are arched towards each other to form two smooth V-shaped contacting portions protruded into the inserting hole. Each of the contacting portions has two spaced smooth ribs protruded from an inner surface thereof and spreading towards two ends of the contacting portion from a peak of the contacting portion to form a smooth V-shape. The ribs of the contacting portions are against opposite portions of the audio plug connector when the audio plug connector is inserted into the inserting hole, respectively.

As described above, when the audio plug connector is inserted into the inserting hole, the ribs of the contacting portions press against opposite portions of the audio plug connector, respectively, which makes the terminal contact with the audio plug connector firmly. Moreover, the structure of the two spaced ribs of each of the contacting portions further makes sure the firm contact with the audio plug connector. Therefore, a steady signal transmission between the audio jack connector and the audio plug connector is ensured.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
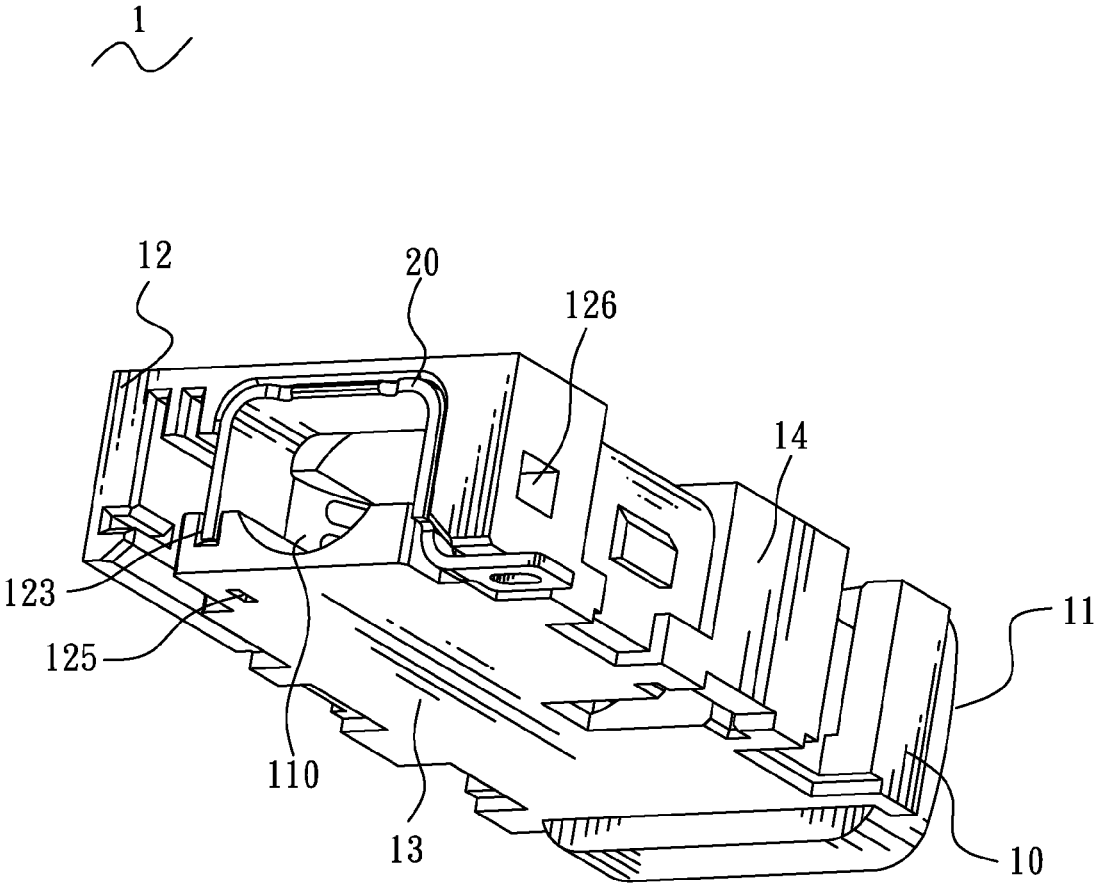
FIG. 1 is a perspective view of an audio jack connector.
Figure 2:
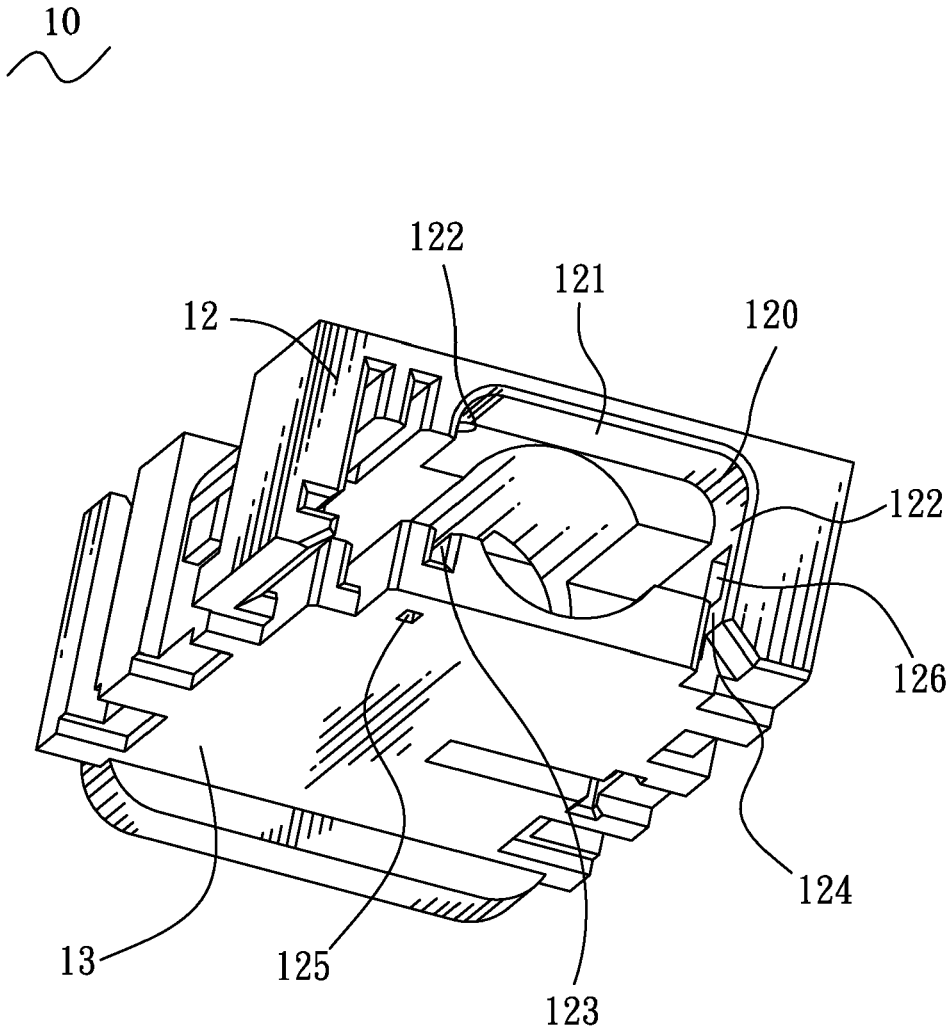
FIG. 2 is a perspective view of an insulating housing of the audio jack connector shown in FIG. 1.
Figure 3:
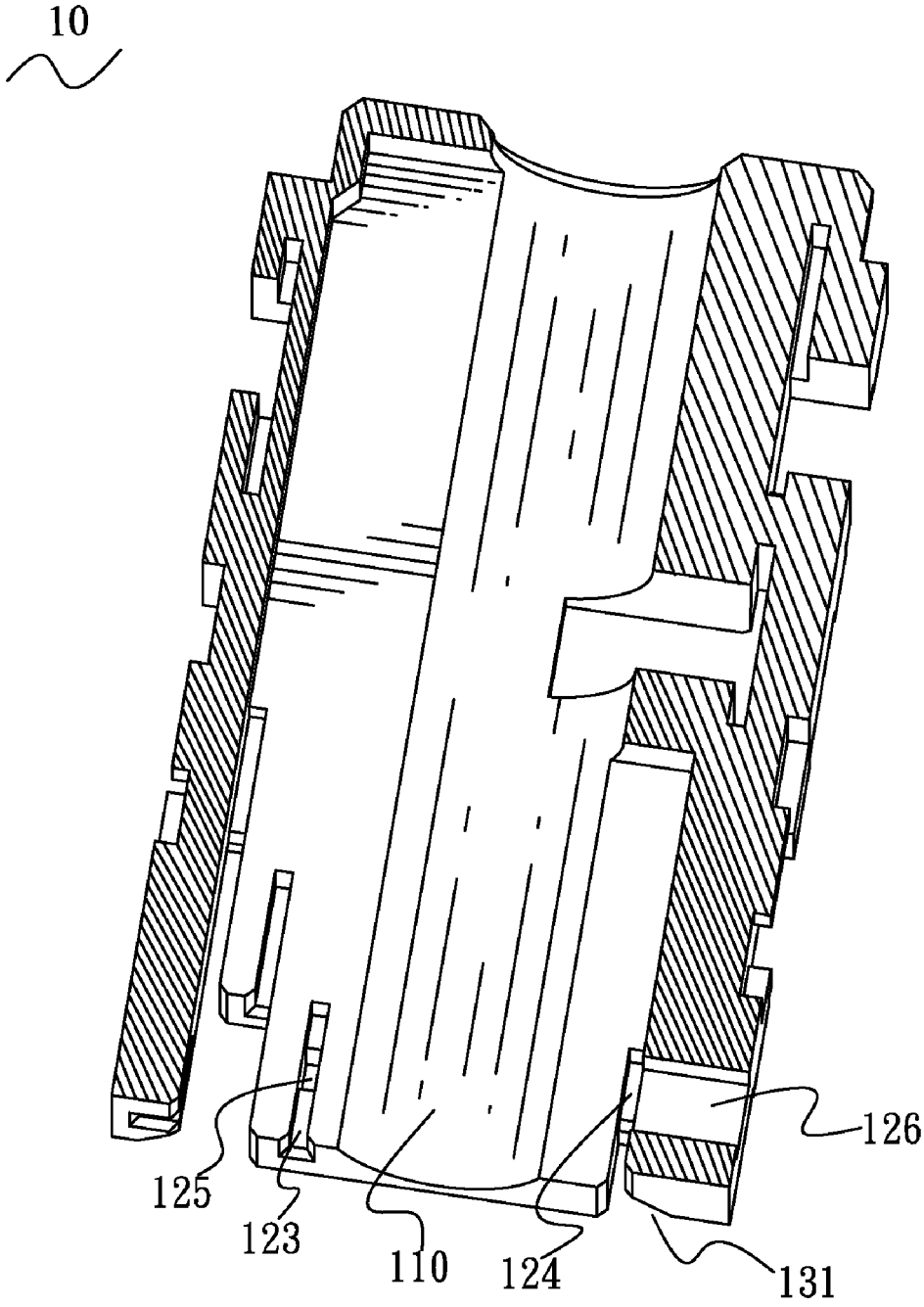
FIG. 3 is a cross-sectional view of the insulating housing of the audio jack connector shown in FIG. 2.

Referring to FIGS. 1-3 and FIG. 5, an audio jack connector 1 according to the present invention is shown. The audio jack connector 1 includes a substantial rectangular insulating housing 10 and a terminal 20. The insulating housing 10 has a front surface 11, a rear surface 12, a bottom surface 13 and a lateral surface 14 adjacent to the bottom surface 13. The front surface 11 has an inserting hole 110 reaching the rear surface 12 of the insulating housing 10 for receiving an audio plug connector 3. The rear surface 12 defines a recess 120 which includes a substantially rectangular main recess 121 intersecting a rear end of the inserting hole 110 and having two facing side surfaces 122 beyond the inserting hole 110. A first fixing groove 123 and a second fixing groove 124 are extended downward from portions of the main recess 121 adjacent to the side surfaces 122, respectively. The first fixing groove 123 is apart from the bottom surface 13. A bottom of the first fixing groove 123 has a portion formed with an inserting aperture 125 penetrating the bottom surface 13. The bottom surface 13 has a notch 131 communicating with the second fixing groove 124 and penetrating through the lateral surface 14 of the insulating housing 10. The side surface 122 adjacent to the lateral surface 14 defines a buckling recess 126.

Figure 4:
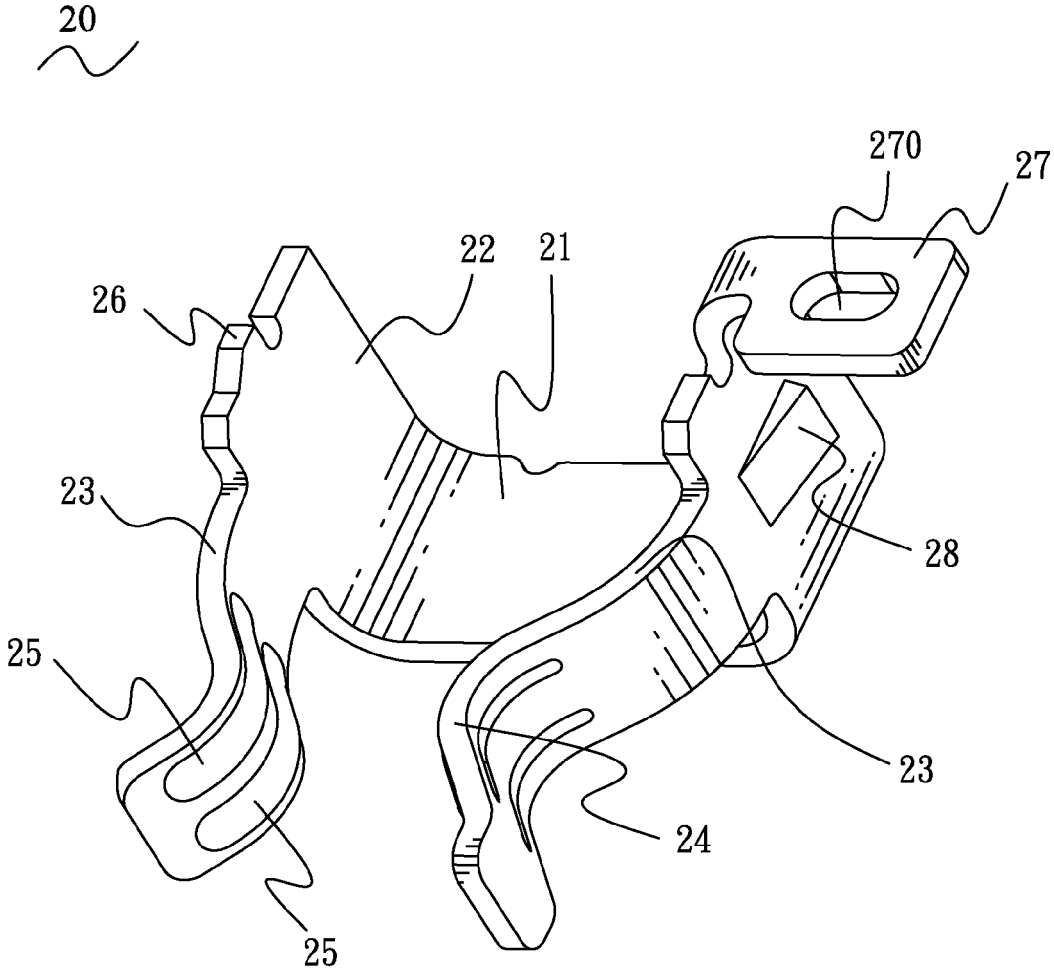
FIG. 4 is a perspective view of a terminal of the audio jack connector shown in FIG. 1 seen from another direction.
Figure 5:
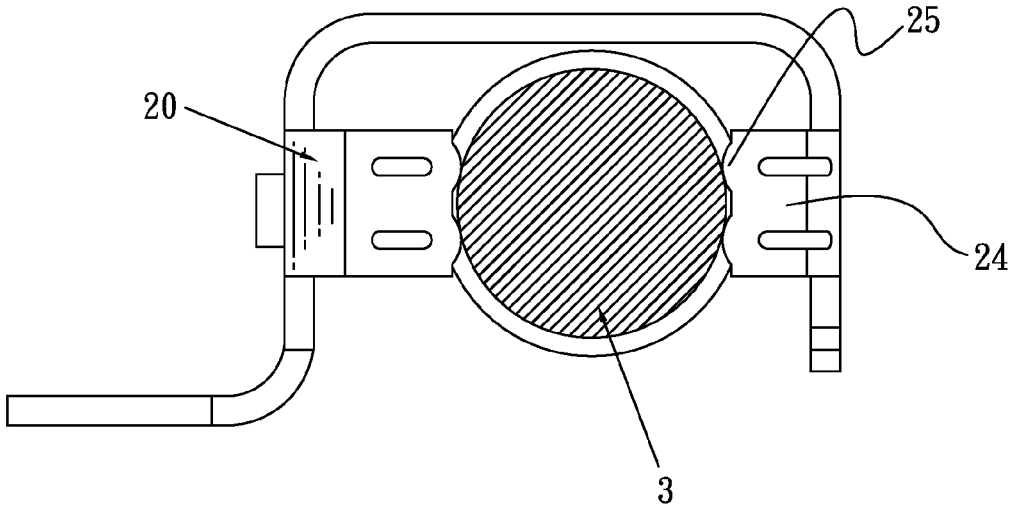
FIG. 5 is a plane view showing a state that the terminal contacts with an audio plug connector.

With reference to FIG. 1 and FIG. 4, the terminal 20 has a base plate 21. Two opposite sides of the base plate 21 extends perpendicularly downwards to form two fixing wings 22. Two facing contacting arms 23 are extended frontward from middles of front edges of the two fixing wings 22, respectively. Free ends of the contacting arms 23 are arched towards each other to form two smooth V-shaped contacting portions 24. Each of the contacting portions 24 has two spaced smooth ribs 25 protruded from an inner surface thereof. The rib 25 spreads towards two ends of the smooth V-shaped contacting portion 24 from a peak of the smooth V-shaped contacting portion 24 to also show a smooth V-shape. A bottom edge of one fixing wing 22 has a portion extended downwardly to form an inserting portion 26. The other fixing wing 22 is formed with a soldering portion 27, which extends opposite to the base plate 21 from a rear end of a bottom edge of the fixing wing 22, and a buckling wedge 28, which protrudes laterally from a side surface of the fixing wing 22 and is at a same side as the soldering portion 27. The soldering portion 27 is formed with a through hole 270 at a substantial middle portion thereof.

Please refer to FIGS. 1-5, in assembly, the terminal 20 is mounted to the insulating housing 10 from the rear surface 12. The base plate 21 is disposed in the main recess 121 and against a top surface of the main recess 121. The two fixing wings 22 are fixed in two sides of the recess 120 and against the side surfaces 122 of the main recess 121, with lower portions thereof engaged into the first fixing groove 123 and the second fixing groove 124, respectively. The inserting portion 26 is inserted into the inserting aperture 125. The buckling wedge 28 is buckled in the buckling recess 126 respectively. The soldering portion 27 is located in the notch 131 for connecting with an external circuit board (not shown). The contacting portions 24 are protruded into the inserting hole 110.

As described above, when the audio plug connector 3 is inserted into the inserting hole 110, the ribs 25 of the contacting portions 24 press against opposite portions of the audio plug connector 3, respectively, which makes the terminal 20 contact with the audio plug connector 3 firmly. Moreover, the structure of the two spaced ribs 25 of each of the contacting portions 24 further makes sure the firm contact with the audio plug connector 3. Therefore, a steady signal transmission between the audio jack connector 1 and the audio plug connector 3 is ensured.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio jack connector for mating with an audio plug connector, comprising:

an insulating housing, the insulating housing defining an inserting hole extended from front to rear for receiving the audio plug connector and a recess communicating with the inserting hole at a rear end thereof, the recess including a substantially rectangular main recess intersecting a rear end of the inserting hole and having two facing side surfaces beyond the inserting hole, a first fixing groove and a second fixing groove extending downward from portions of the main recess adjacent to the two side surfaces, respectively; and a terminal received in the recess, the terminal having a base plate, two opposite sides of the base plate extending downwards to form two fixing wings, two facing contacting arms being extended frontward from two front edges of the two fixing wings, free ends of the contacting arms being arched towards each other to form two smooth V-shaped contacting portions protruded into the inserting hole, each of the contacting portions having two spaced smooth ribs protruded from an inner surface thereof, the rib spreading towards two ends of the contacting portion from a peak of the contacting portion to also show a smooth V-shape, the base plate disposed in the main recess and against a top surface of the main recess, the two fixing wings being fixed in two sides of the recess and against the side surfaces of the main recess, with lower portions thereof engaged into the first fixing groove and the second fixing groove, respectively;

wherein the ribs of the contacting portions are against opposite portions of the audio plug connector when the audio plug connector is inserted into the inserting hole, respectively.

2. The audio jack connector as claimed in claim 1, wherein the first fixing groove is apart from a bottom surface of the insulating housing, a bottom of the first fixing groove has a portion formed with an inserting aperture for engaging an inserting portion extended downward from a portion of a bottom of one of the fixing wings.

3. The audio jack connector as claimed in claim 1, wherein the bottom surface has a notch communicating with the second fixing groove, one of the fixing wings is formed with a soldering portion, which extends opposite to the base plate from a bottom edge of the fixing wing, the soldering portion is received in the notch.

4. The audio jack connector as claimed in claim 3, wherein the soldering portion is formed with a through hole at a substantial middle portion thereof.

5. The audio jack connector as claimed in claim 1, wherein a portion of the side surface of the main recess defines a buckling recess for buckling with a buckling wedge protruded outward from a portion the fixing wing.

* * * * *